US006257153B1

(12) United States Patent
Portugal

(10) Patent No.: US 6,257,153 B1
(45) Date of Patent: Jul. 10, 2001

(54) T-TABLE

(75) Inventor: Antonio Fernandes Portugal, Jupiter, FL (US)

(73) Assignee: Antonio F. Portugal, Jupiter, FL (US)

( * ) Notice: Subject to any disclaimer, the term of this patent is extended or adjusted under 35 U.S.C. 154(b) by 0 days.

(21) Appl. No.: 09/431,537

(22) Filed: Oct. 29, 1999

Related U.S. Application Data

(60) Provisional application No. 60/105,739, filed on Oct. 26, 1998.

(51) Int. Cl.[7] ..... A47B 3/00
(52) U.S. Cl. ..... 108/115; 108/124
(58) Field of Search ..... 108/115, 124; 248/188.6, 188.1, 167, 434

(56) References Cited

U.S. PATENT DOCUMENTS

| | | | | |
|---|---|---|---|---|
| 318,110 | * | 5/1885 | Harnish | 108/115 |
| 943,236 | * | 12/1909 | Campbell | 108/115 |
| 2,055,007 | * | 9/1936 | Erpelding | 108/124 |
| 3,313,249 | * | 4/1967 | Marcy | 108/124 |

FOREIGN PATENT DOCUMENTS

| | | | | |
|---|---|---|---|---|
| 156914 | * | 1/1921 | (GB) | 108/115 |
| 397954 | * | 9/1933 | (GB) | 108/124 |
| 628080 | * | 8/1949 | (GB) | 108/115 |

* cited by examiner

*Primary Examiner*—Janet M. Wilkens

(57) ABSTRACT

A sturdy collapsible wooden TV/sofa table for use with a chair, couch or sofa, comprising of a foldable tabletop and folding t-shaped leg supports. The foldable tabletop comprises of two coplanar pieces mounted together by two hinges. One of the coplanar portions is a great deal smaller than the other thus allowing for the tabletop to fold into a parallel position against its leg supports when in the collapsed form. The leg supports are also mounted pivotally to each other by two hinges. One leg is mounted perpendicular to the tabletop piece while the other is hinged lengthwise to the middle of the longer portion of the tabletop and folds parallel to it when in the collapsed position. The movable hinged leg is designed to hold the tabletop in the upright position when in use, where it is fastened to a finger latch located underneath the tabletop. The finger latch keeps the leg from moving from its t-shaped position while in the upright position. There is also a z-bracket mounted underneath the tabletop in order to prevent the tabletop from unlatching itself while in the upright position. A button latch is mounted to the underside of the front end of the tabletop and a button clip is mounted on the inner side of leg. In the collapsed position, the button latch engages into the button clip, allowing the tabletop and leg supports to be firmly secured together in a parallel form. This allows for easy storage of the T-table in a collapsed position so as to decrease the amount of space it occupies. The movable hinged leg also contains a handle so as to aid in opening the table and closing it as well as making it portable. This handle is positioned in a manner so as to store the table on its side where it can remain in a stable position without any auxiliary supports.

7 Claims, 2 Drawing Sheets

T-TABLE

CROSS-REFERENCE TO RELATED APPLICATIONS

This appln claims the benefit of Provisional No. 60/105,739 filed Oct. 26, 1998.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention as it pertains to its field of endeavor, is intended and designed to solve a long-term discrepancy among conventional TV/sofa tables and trays. It relates to tables and more particularly to a folding, collapsible, TV/sofa table which can be conveniently positioned when in use or folded up into a collapsed state for desired storage.

When dining in front of the television, doing homework at the sofa/couch, entertaining guests, or using your laptop computer, it is usually difficult to find a nice, sturdy and flat surface to do your work or relax. There are pieces of furniture specifically designed for these types of things, but they are usually big and awkward and need a lot of storage space. With the T-Table, all of these activities can be accomplished with little bulk and effort, thus making it convenient to work or enjoy yourself in the convenience of your own home or elsewhere, being that the T-Table is portable as well.

BRIEF SUMMARY OF THE INVENTION

It is one object of the present invention to provide a portable table, which can be conveniently folded up and collapsed when not in use. It is another object of the present invention to provide a collapsible TV/sofa table, which addresses the problems involved with conventional TV/sofa tables. According to the preferred embodiment of the present invention, its utilization solves several problems and is idealistic in the fact that it allows for a sturdy table that can be used in various locations for varied reasons. Whether you are reading, using a laptop computer, or enjoying a snack, meal, or beverage, the present invention is the perfect companion. It may be positioned next to a chair or sofa/couch where it can be brought right up to you and allows for a remarkable amount of legroom. This is the beauty of the present invention. Unlike conventional tables that are a drag in that they are either on top of you or cramp your legs when in use, the present invention allows for ample legroom, while remaining superior in its use as a customary table. Also, those heavy, awkward sofa tables usually end up clipping your fingers while trying to use, which can be dangerous. The present invention is easy to use and light weight making it a useful companion. Not only is it a useful companion, but the present invention makes for a beautiful piece of furniture designed virtually for any room in the home. Its flat surface tabletop is superb for beverages, food, or accessories, making the present invention the most versatile and attractive piece of furniture available.

BRIEF DESCRIPTION OF THE SEVERAL VIEWS OF THE DRAWING

To illustrate further the object of the present invention, some embodiments of the invention are described below.

DETAILED DESCRIPTION OF THE INVENTION

Figure 1:
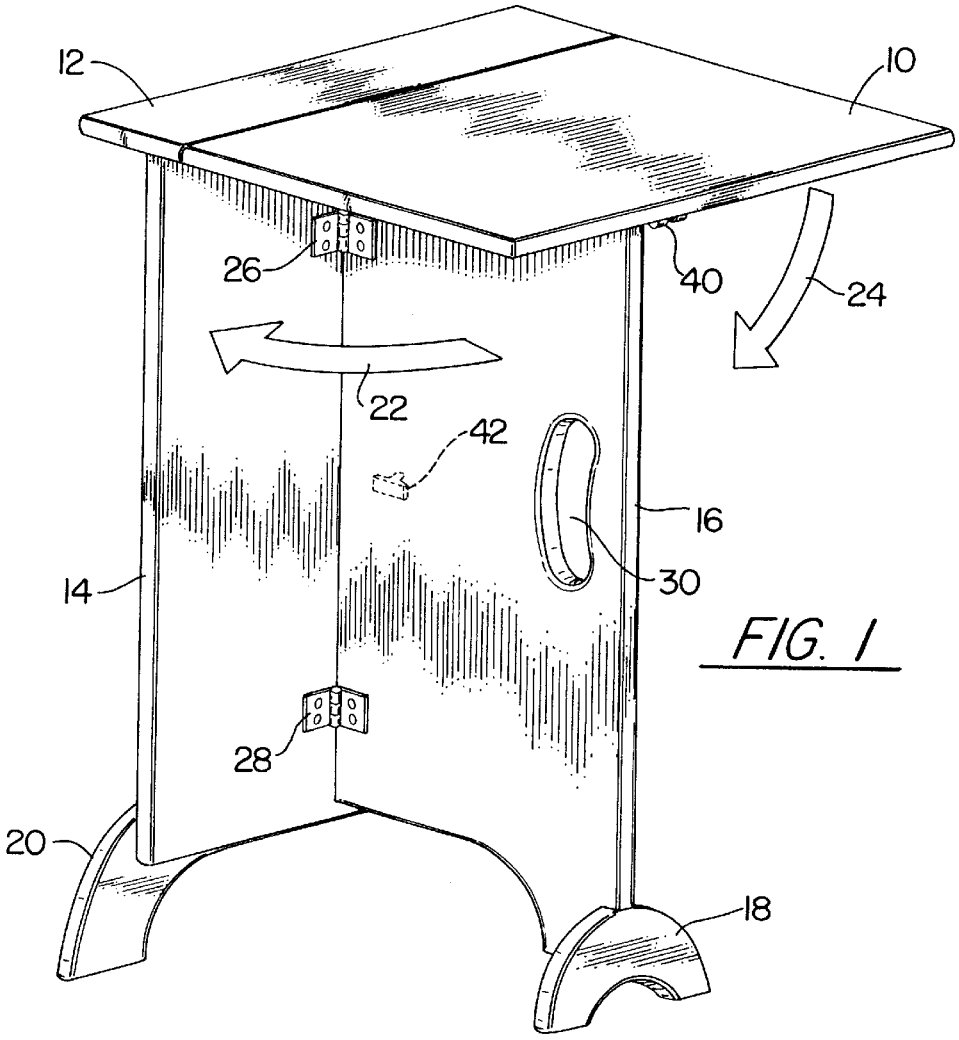
FIG. 1, depicts the actual rear side view of the invention in its upright position with arrows showing the areas of where the folding of the coplanar portions of the table takes place and the layout of the table can be clearly seen (with hinge, latch, clip, and bracket elements clearly placed).
Figure 2:
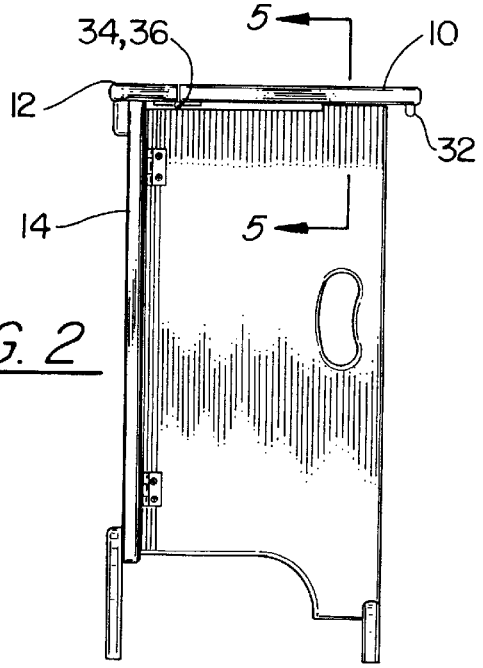
FIG. 2, portrays a profile view of the invention in its upright position, depicting where the handle is placed for portability.
Figure 3:
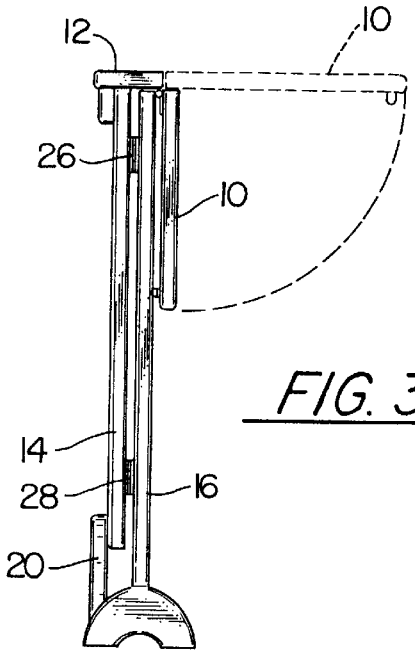
FIG. 3, is a profile view of the same degree except the table is in its upright collapsed form where one can clearly see the folding of the primary coplanar leg and primary coplanar top as they are stacked in a parallel fashion up against the secondary leg and against each other to form this collapsed illustration.
Figure 4:
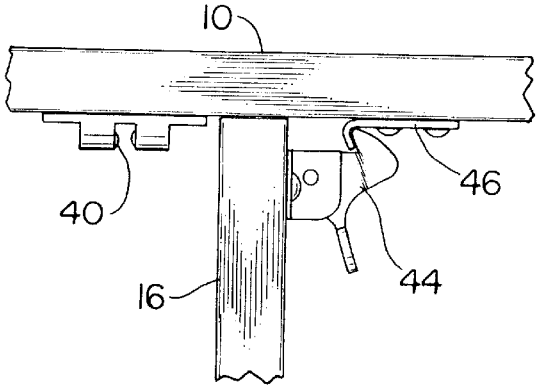
FIG. 4, illustrates, on an enlarged scale, the area of the table at the top rear which depicts the finger latch device (44 & 46)) used for locking the table securely while in the upright position and the button latch (40) used for locking the table with its complementary button clip (42—found on the primary coplanar leg) when in the collapsed position.
Figure 5:
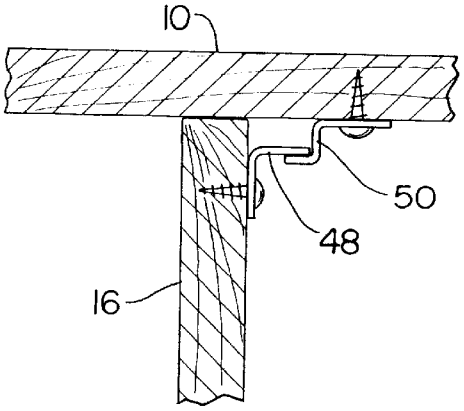
FIG. 5, represents the enlarged view of the z-bracket that is found in the middle and underneath the primary coplanar tabletop; it is used for keeping the primary tabletop from lifting while in the upright position.
Figure 6:
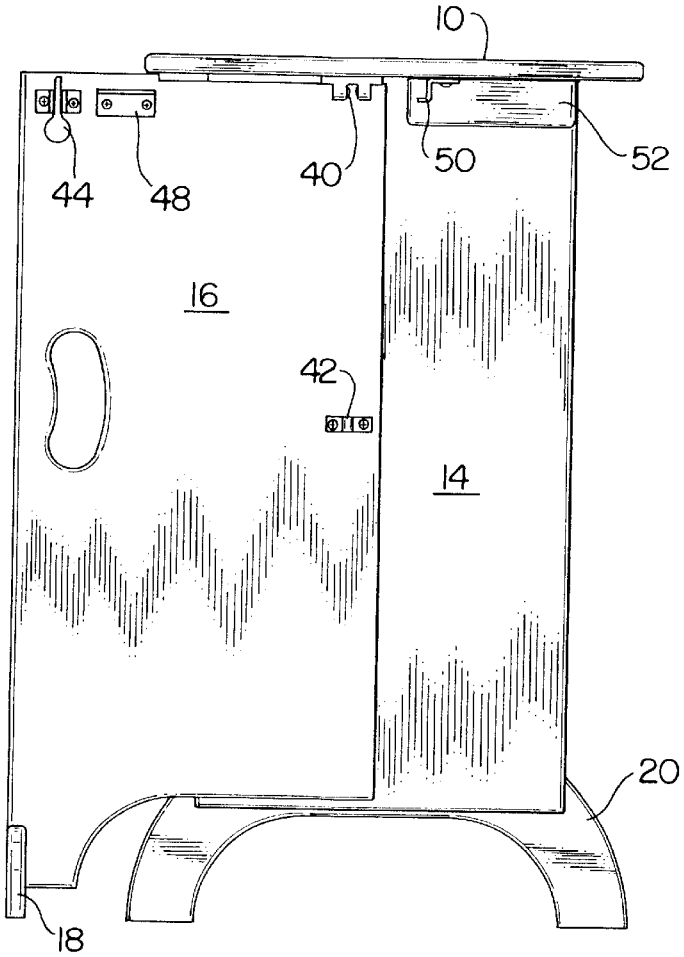
FIG. 6, shows clearly the latches, clips, and catches used in constructing the table and their respective locations in relation to the table.
Figure 7:
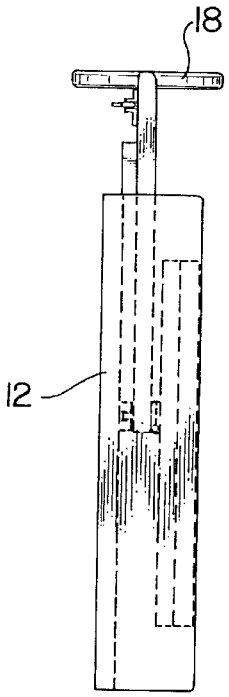
FIG. 7, illustrates the front view of the invention as it is in its collapsed form, sitting in an uprght position without any accessory holding device(s) as mentioned earlier.

A sturdy collapsible wooden table comprising of a foldable tabletop (10 & 12) and folding t-shaped leg supports (14 & 16). The foldable tabletop comprises of two coplanar pieces (10) and (12) mounted together by two butt hinges (34 & 36). One of the coplanar portions (12) is a great deal smaller than the other (10) thus allowing for the tabletop to fold into a parallel position against its leg supports when in the collapsed form (FIG. 3 & FIG. 7). The leg supports are also mounted pivotally to each other by two butt hinges (26 & 28). One leg support (14) is mounted perpendicular to the tabletop piece (10) while the other leg support (16) is hinged lengthwise to the middle of (14) and folds parallel to (14) when in the collapsed position. The movable hinged leg (16) is designed to hold the tabletop in the upright position (FIG. 1) when in use, where it is fastened to a finger latch (44 & 46) located underneath the tabletop (FIG. 4). The finger latch (44 &46) keeps the leg (16) from moving from its t-shaped position while in the upright position. There is also a z-bracket (48 & 50) mounted underneath the tabletop (FIG. 5) in order to prevent the tabletop from unlatching itself while in the upright position. A button latch (40) is mounted to the underside of the front end of the tabletop (FIG. 4) and a button clip (42) is mounted on the inner side of leg (16). In the collapsed position (FIG. 3 & FIG. 7), the button clip (42) engages into the button latch (40), allowing the tabletop and leg supports to be firmly secured together into a parallel form. This allows for easy storage of the T-Table in a collapsed position (FIG. 3 & FIG. 7) so as to decrease the amount of space it occupies. The movable hinged leg (16) also contains a handle (30) so as to aid in opening the table and closing it as well as making it portable. This handle is positioned in a manner so as to store the T-Table on its side (FIG. 7) where it will remain stable without any auxiliary supports.

In order to construct the T-Table using wood in this sense, one would have to be knowledgeable in the art of skilled craftsmanship. First, cut flat leg boards precisely according to the proper measurements. Round off the leg board edges and sand them, allowing for a smooth orientation. Second, cut out two arch-shaped foot supports (20) and (18). Next, mount arch-shaped foot support (20) to the bottom surface of leg support (14) using glue and finishing nails. Third, cut out carrying handle (30) on leg support (16). Notch the bottom edge of leg support (16) and attach a smaller arch-shaped foot support (18) using glue and finishing nails. These foot supports not only add design finish to the T-Table, but also allow for a sturdier structure when in the upright position. Next, take the two leg supports (14) and (16) and attach them together with two butt hinges (26 & 28). Fourth, cut two rectangular pieces (12) and (10) for the tabletop; round the edges and sand. Attach these two tabletop pieces (12) and (10) together with two butt hinges (34 & 36). Next, cut a smaller rectangular strip (52); round the edges and sand. The said strip gives extra support to the tabletop. Mount this strip to the underside of tabletop piece (12) using glue and finishing nails. Fifth, take the tabletop face down and place leg supports upside down on top of the tabletop. Using glue and finishing-nails, attach leg support (14) to tabletop piece (12) and support piece (52). Finally, place the following latches, clips, and bracket accordingly to design specifications: finger latch with clip, button latch with clip, and z-bracket. Optional staining or wax finish may be applied.

What I claim as my invention is:

1. An erecting table comprising a rectangular-shaped top, consisting of two coplanar portions: a small auxiliary portion that is statically joined to an auxiliary leg where said auxiliary leg is mounted perpendicular to said auxiliary portion of the table top, and a main portion that makes up the majority of the table top and is hingedly secured to said auxiliary table top portion so as to be alternatively foldable down against a main leg when in a collapsed state or foldable up to form the complete table top for the table when in an erected state; said auxiliary leg remains static in a perpendicular state to said auxiliary table top where it is securely fixed to said auxiliary table top; said main leg, which is hingedly connected to the auxiliary leg so as to be alternatively located in side-by-side parallel relation with the auxiliary leg when the table is in a collapsed state or to pivot into a perpendicular state to the auxiliary leg, forming a T-shaped structure, to assist in supporting said main table top portion when the table is in an erected state.

2. A table according to claim 1, further comprising supplemental arc-shaped leg supports, one located at each respective base of the main leg and auxiliary leg, which allows for sturdy support of the table when it is in the erected state.

3. A table according to claim 1, wherein the main leg and auxiliary leg are connected by two butt hinges and the main table top portion along with the auxiliary table top portion are also connected by two butt hinges; these butt hinges allow for the pivotal movement of the main leg and the main table top portion respectively in order to generate the collapsed state or the erected state of the table.

4. A table according to claim 1, further comprising a finger latch and z-bracket located on the underside of the main table top portion and the main leg; the finger latch and z-bracket are used for keeping the main portion of the table top and main leg in a secure state when the table is in the erected state.

5. A table according to claim 1, further comprising a button clip located on the underside of the main table top portion and the main leg respectively and used as a securing device in order to maintain the table in a parallel form when in the collapsed state.

6. A table, according to claim 1, further comprising an ovular-shaped cutout located on the main leg, which is used as a means of making the table portable when in the collapsed state or assisting in the table's functionality when generating the transition from the collapsed state to the erected state.

7. A table according to claim 1, wherein the auxiliary leg and main table top portion act as a supplemental stand for the table when it is in the collapsed state, so as to allow the table to remain stable on its side without any auxiliary supports or holding devices.

* * * * *